United States Patent [19]

Barari et al.

[11] Patent Number: 4,589,981

[45] Date of Patent: May 20, 1986

[54] FLUIDIZED BED CLASSIFIER

[75] Inventors: Hari B. Barari; Lance A. Mullins, both of Colorado Springs, Colo.

[73] Assignee: Joy Manufacturing Company, Pittsburgh, Pa.

[21] Appl. No.: 560,730

[22] Filed: Dec. 12, 1983

[51] Int. Cl.[4] ..... B07B 3/02

[52] U.S. Cl. ..... 209/474; 209/490

[58] Field of Search ..... 209/474, 475, 476, 490, 209/493, 494, 492; 422/141, 142

[56] References Cited

U.S. PATENT DOCUMENTS

| | | | |
|---|---|---|---|
| 1,695,369 | 12/1928 | Davis | 209/474 |
| 2,014,291 | 9/1935 | Reed | 209/475 |
| 2,561,396 | 6/1951 | Matheson . | |
| 2,606,144 | 8/1952 | Leffer . | |
| 2,666,526 | 1/1954 | Odell et al. . | |
| 2,715,548 | 8/1955 | Fish | 422/142 |
| 3,288,282 | 11/1966 | Eveson et al. . | |
| 3,333,692 | 8/1967 | Eveson et al. | 209/474 |
| 3,351,202 | 11/1967 | Resnick et al. . | |
| 3,610,415 | 5/1969 | Deak . | |
| 3,774,759 | 11/1973 | Weinstraub et al. . | |
| 4,118,337 | 10/1978 | Gross et al. | 208/113 |
| 4,127,476 | 11/1978 | Iannazzi | 209/490 |
| 4,287,088 | 9/1981 | Sirkar | 209/158 |
| 4,404,086 | 9/1983 | Oltrogge | 208/8 R |
| 4,409,101 | 10/1983 | Salikhov et al. | 422/142 |
| 4,430,195 | 2/1984 | Oltrogge | 208/8 R |

*Primary Examiner*—Barry S. Richman
*Assistant Examiner*—Titus B. Ledbetter, Jr.
*Attorney, Agent, or Firm*—Edward L. Levine

[57] ABSTRACT

Fluidized bed systems for segregating cleaning or classifying particulate matter of differing physical properties such as particle density or size. Multiple stage beds preferably operate in a partially fluidized state and the classification structure provides for full peripheral discharge of both floats from the upper portion of each bed and sinks from the lower portion of each bed to alleviate the tendency of fluidized medium to both short circuit the particles of the upper stage and restrict the flow of particles from the upper stage to the lower stage.

3 Claims, 10 Drawing Figures

FLUIDIZED BED CLASSIFIER

FIELD OF THE INVENTION

This invention relates to classification of particulate materials of differing specific gravity or size, and more particularly to partially fluidized bed particulate classifiers.

BACKGROUND OF THE INVENTION

It is well known to utilize fluidized beds for cleaning, classifying or other processing of particulate materials. Multiple stage fluidized beds often include a perforated horizontal plate through which a fluidizing medium, such as air, upwardly flows to fluidize particulate matter supported on the plate. Particles of, for example, higher specific gravities tend to sink to the bottom of the bed while particles of lower specific gravity float to the top of the bed. The upper particles rise to an elevation above one or more downcomer tubes, fall into the tube, and are discharged onto another perforated plate supporting a lower bed in the next lower stage. The lower particles are generally removed in a continuous or batch process through lateral pipe outlets. The fluidizing medium passes serially upwardly through the lower perforated plate, the bed supported on the lower plate, the upper perforated plate and the upper bed.

Several concerns arise in operation of such systems. For example, the downcomers present a path of lower resistance whereby the fluidizing medium tends to short circuit the particles of the upper bed-stage as well as restricting the downflow of particulates from the upper stage to the lower stage. This increases the amount of fluidizing medium required to achieve a given fluidized condition in particularly the upper bed and to achieve a given mass throughput. It also requires a larger diameter bed since the cross sectional area for fluidization is reduced by the area of the downcomers. To control the throughput, such systems also rely not only on the rate of feed into the uppermost bed, but often also on some type of valving to control flow through the downcomer. Valving or seals are often utilized to alleviate the short circuiting path. Additionally, since the downcomers are localized at various regions of the bed, the particle distribution is not even, and can provide an imbalance in the type of particles being discharged from the bed. The quality of fluidization within a bed having downcomers is also affected by an imbalanced distribution of the fluidizing medium.

It has been recognized that some of these concerns can be alleviated through use of a structure such as that disclosed in U.S. Pat. No. 3,333,692 which is useful for drying and subsequent cleaning of particulate materials. The structure and operation of the device disclosed therein is substantially different from more conventional fluidized bed classifiers or cleaners because the upper stage is designed merely to dry and dedust the particulate material. No separation per se occurs there, all of the dried and dedusted particles eventually being transferred through a downcomer to a lower bed for separation in a fluidized bed of a material, such as magnetite, having a specific gravity intermediate the high density and low density portions of the feed material. Particularly in cases where a single drying and dedusting bed is desired to be associated with more than one bed of magnetite, the product from drying and dedusting is divided into plural streams. This is accomplished by an annular hooded peripheral launder divided into sections, each having a corresponding outlet pipe, by radially positioned vertical plates. The dried and dedusted particulates overflow from the bed into the adjustable height peripheral launder, and are directed through the pipes into the magnetite bed, which can be positioned below the drying and dedusting bed. While not clearly taught, the use of a peripheral overflow launder allows the elimination of the central downcomer and alleviation of attendant concerns.

With such system, the possibility for short circuiting and the desirability of sealing means and control valves remain. However, the fluidizing medium distribution and product imbalance concerns are lessened. Where, for example, the drying and dedusting bed is only partially fluidized, the particles of higher specific gravity would tend to stagnate at the lower portion of the bed, and not overflow unless the adjustable height launder is moved to a very low position whereby the bed height becomes shallow, allowing little height for the particulate segregation and thereby the separation becomes less effective.

It is desirable to provide a fluidized classification system which alleviates the above discussed and other concerns associated with prior classifying systems.

SUMMARY OF THE INVENTION

This invention provides a multiple-stage fluidized bed particle classifier operable at relatively low rates of flow of the fluidizing medium for a given throughput. It also allows, for a given throughput, fluidizing zones of smaller cross sectional area than prior systems. Additionally, a well balanced, even distribution of multiple particle streams is attained.

In preferred form the system includes a vertical jacket within which are supported two or more perforated grates, one spaced above the other. Supported to extend above each grate is a peripheral, preferably cylindrical housing. Immediately above the grate, is formed a circumferential peripheral opening. Another peripheral opening is provided at the top of the housing, preferably being the open top of the housing.

A fluidizing medium, such as a gas or a liquid, for example, air or water, is passed serially upwardly through the lower and then the upper grate. A particulate feed material is fed downwardly onto the upper grate through an inlet tube and is bounded laterally by the upper housing. The inlet tube extends significantly into the bed of material so that under steady state operation, the tube contains sufficient material to form a so termed static head which blocks the fluidizing medium from flowing through the tube. Under the influence of the upwardly flowing fluidizing medium at partial fluidization conditions, the particles separate into an upper floats fraction which is in the fluidized state and a lower sinks fraction which is in a packed state. The system is preferably operated such that the bed of particulate matter to be classified operates as a partially, as opposed to a fully, fluidized bed. The particle separation is based upon differing physical characteristics among the particles, such as size or specific gravity. Particles which are larger or of higher specific gravity tend to form the sinks fraction, and particles which are smaller or of lower specific gravity tend to form the floats fraction.

The floats circumferentially and evenly overflow the upper housing through the upper peripheral opening, and enter a downwardly directed floats annulus. The sinks circumferentially and evenly flow laterally through the lower peripheral opening and enter a downwardly directed sinks annulus. One of the sinks and the floats in the annuli is directed to the lower stage, and the other is directed outwardly from the jacket. For example, where raw particulate eastern coal is to be classified, the floats may comprise a product which is sufficiently clean and of low ash content such that it can be directed from the jacket directly to a receptacle and ultimately to the user. The sinks, containing some desirable coal as well as a greater percentage of undesirable ash forming impurities and wastes, are directed into the lower peripheral housing and, through an internal tube extending substantially into the lower bed, onto the lower grate. In the lower stage another separation occurs into what is herein termed a secondary fraction (upper portion of bed) and a refuse fraction (lower portion of bed). The secondary fraction may be usable as is, or may be mixed in a desired ratio with the original floats product from the upper stage. The refuse can be further processed in a subsequently lower stage, or discharged as waste. Any number of consecutive stages can be utilized, as can a singular stage.

When using the system in connection with other processes, for example for processing foundry sand or food materials, the desirable product may be the sinks fraction of each successive stage. It is desirable, whether the sinks or the floats fraction comprises the desired product, to operate the unit as a partially fluidized bed, which requires a substantially less volumetric flow rate of fluidizing medium as compared to a fully fluidized operating mode.

It will be apparent that with the disclosed system, including peripheral discharge at both the upper and lower regions of a fluidized bed, many of the limitations of the prior art are alleviated. There is no downcomer or other discharge from the body of the bed to interfere with particle or fluid flow mechanisms. Short circuiting is alleviated. The absence of a central discharge also increases the available fluidizing cross section, allowing for a smaller unit. And, because of the balanced, uniform peripheral discharge, a more even product distribution is obtained. Valves and seals between the stages are not required, although valving may be used, as a result of the static head in the feed tubes and because the feed rate into the upper stage can be adjusted, along with the elevation of the upper opening and the area of the lower opening, whereby the particulate material input rate is directly dependent upon the output rate, and not a feed valve setting.

BRIEF DESCRIPTION OF THE DRAWINGS

The advantages, nature and additional features of the invention will become more apparent from the following description, taken in connection with accompanying drawings, in which.

DESCRIPTION OF THE PREFERRED EMBODIMENTS

Figure 1:
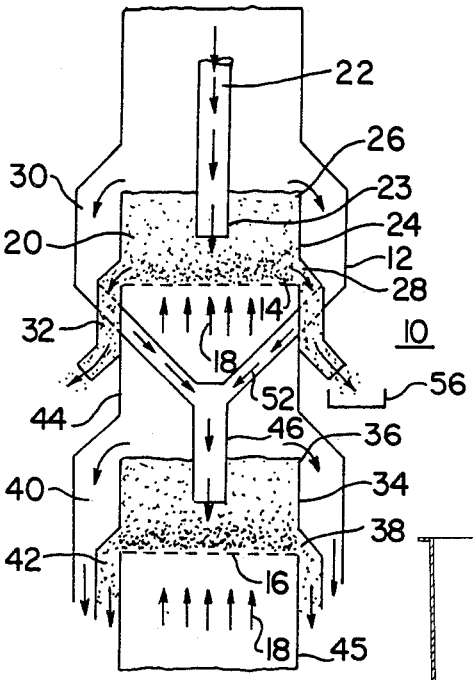
FIG. 1 is a simplified cross sectional elevation schematic of a classifier in accordance with the invention.

Referring now to FIG. 1 there is shown a portion of a multiple stage fluidized bed classifier 10 in accordance with the invention. The outer boundary of the classifier is herein referred to as a jacket 12, and is formed of a number of components described further hereinafter. This exemplary classifier system is shown and described with respect to two stages, although any number of stages can be utilized. The classifier includes an upper perforated plate 14 and a lower perforated plate 16. The plates 14, 16 are preferably circular and are perforated as well known to allow passage therethrough of a fluidizing medium indicated by arrows 18. The plates 14, 16 are preferably each placed on a grate which provides structural support. The placement and sizing of the perforations in the plates 14, 16 are selected in accordance with conventional fluidizing technology.

A nonhomogeneous particulate material 20 to be processed, for example to be classified into fractions with respect to specific gravity, is fed downwardly at a selected rate onto the upper plate 14 through an inlet tube 22. The material 20 is laterally supported above the plate 14 by a peripheral, preferably cylindrical upper housing 24. The height of the upper housing 24 is preferably adjustable. A peripheral opening is provided at or near the upper end of the upper housing 24, and preferably is formed of an open top 26 of the housing 24. A lower peripheral opening 28 is also provided by the upper housing at or near the upper plate 14. The inlet tube 22 or an extension of the tube is mounted to allow for sliding vertical movement of a discharge end 23 of the tube. It has been found that during fluidizing operation the particulate material 20 forms an interface region within the bed and that separation among particles is enhanced when the material 20 is discharged into the bed at the elevation of the interface region. For a given particulate material, the optimum discharge elevation and fluidizing medium flow rate can be predetermined through testing.

Figure 1A:
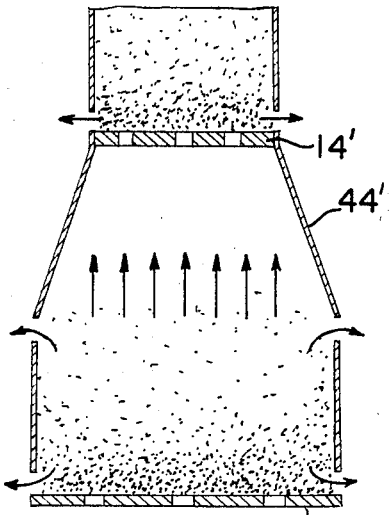
FIG. 1A is a schematic of a portion of an alternative classifier configuration.
Figure 4:
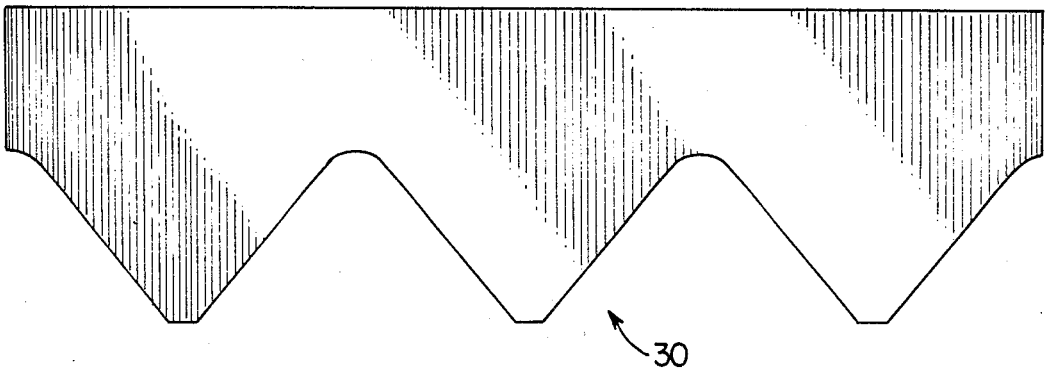
FIGS. 4 and 5 are respectively a flat pattern and a front view of the outer shell of the classifier of FIG. 2.
Figure 5:
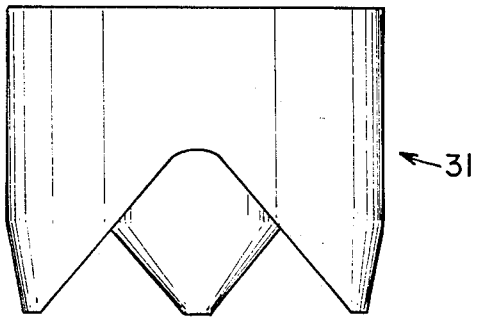

Laterally surrounding and communicating with the periphery of the upper peripheral opening 26 is an upper floats annulus 30 formed in part by a coat 31 (FIGS. 4 and 5). Laterally surrounding and communicating with the periphery of the lower peripheral opening 28 is an upper sinks annulus 32. In similar fashion associated with the lower perforated plate 16 is a lower bed lower housing 34, lower bed upper peripheral opening 36, lower bed lower peripheral opening 38, a lower bed middlings annulus 40 and a lower bed refuse annulus 42. Between the upper and lower stages is a shell 44 which generally defines the cross sectional area through which the fluidizing medium flows and which is generally aligned with the periphery of the upper 14 and lower 16 perforated plates. Although the perforated plates 14, 16 and shell 44 are shown in FIG. 1 as being of common diameter, other configurations are equally possible. For example, FIG. 1A schematically shows a system having an upper perforated plate 14' which is of smaller diameter than a lower perforated plate 16', and a shell 44' is formed as a truncated cone. Similarly, a baffle can be incorporated in one of the beds to provide differing effective diameters among the beds. In this manner the velocity of the fluidizing medium can be accommodated such that preselected fluidizing characteristics can be established in the upper and lower beds.

During operation the particulate material 20 flows through the inlet tube 22 and forms a partially fluidized bed in the area bounded by the upper perforated plate 14 and the upper housing 24. As the particles segregate, a floats fraction overflows the entire circumferential periphery of the housing 24 and enters the upper floats annulus 30. It then flows under the force of gravity downwardly and into an interior tube 46. The interior tube 46 or an extension thereof is preferably movably mounted and extendable into the interface region within the lower bed. The annulus preferably narrows at its lower ends to a plurality of outlets 48 and ramps 50, shown best through FIGS. 2, 4, 5 and 6. In the preferred configuration shown, the outlets 48 communicate with three chutes 52 (FIGS. 1 and 2) which interconnect with the interior tube 46.

The sinks fraction flows through the lower peripheral opening 28, into the sinks annulus 32 and, under the force of gravity over ramps 52 to a plurality of outlets 54. The sinks fraction is discharged to one or more receptacles 56 outside of the jacket 12. The outlets 54 and ramps 52 configuration of the sinks annulus is preferably similar to, but of differing interior and exterior dimension than, the configuration of the floats annulus. The classifier can also be configured so that the sinks fraction is discharged to the lower bed and the floats fraction is discharged to the receptacles. The classifier can further be configured as a single stage unit with both annuli discharging to external receptacles.

Figure 8:
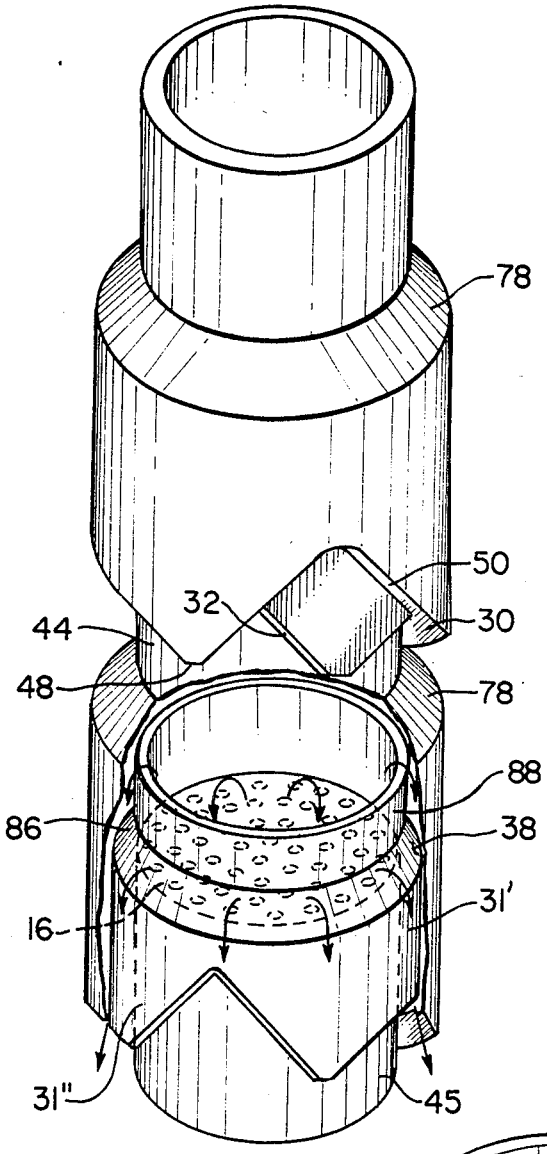
FIG. 8 is a view, similar to FIG. 6, showing in particular a preferred configuration for forming discharge openings and annuli and for supporting a perforated plate in accordance with the invention.
Figure 9:
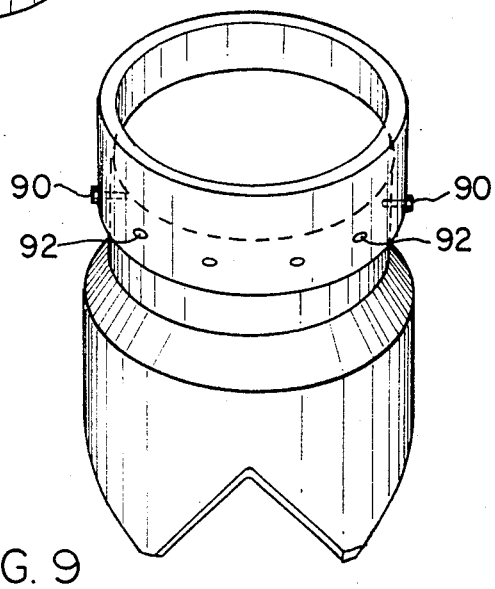
FIG. 9 is a view, similar to FIG. 8, showing one means of structural attachment among selected components.

FIGS. 8 and 9 show further detail of the relative position and attachment among selected components. The lower perforated plate 16 is supported atop a lower shell 45. Surrounding and spaced about the upper portion of the shell 45 is an inner coat 31'. It can be seen that the lower peripheral opening 38 is formed as the space between the periphery of the lower perforated plate 16 and the inner coat 31'. The inner coat 31' shown in FIG. 8 includes a truncated conical cover 86 and a vertical section 88 which section 88 forms the lower housing 34. The size, orientation and elevation of the inner coat 31', and particularly the conical cover 86, establishes the magnitude of the lower peripheral opening. Surrounding the inner coat 31' is an outer coat 31'', which forms the lower bed secondary annulus 40. The overflow from within the vertical section 88 immediately enters the annulus 40. It will be evident that the disclosed configuration readily permits peripheral, three hundred and sixty degree discharge at the bottom and top of the fluidized bed. Components forming the openings and annuli can be affixed in conventional manners, forming subassemblies, such as by welding or bolting. The coats, for example, are preferably welded along the plural seams forming the coats and ramps. These subassemblies can then be joined, for example, through bolting. FIG. 9 shows bolts 90 through bolt holes 92 in the vertical portions of selected components. The height of the bed can be adjusted by selection of the elevation of the bolt holes 92.

Figure 2:
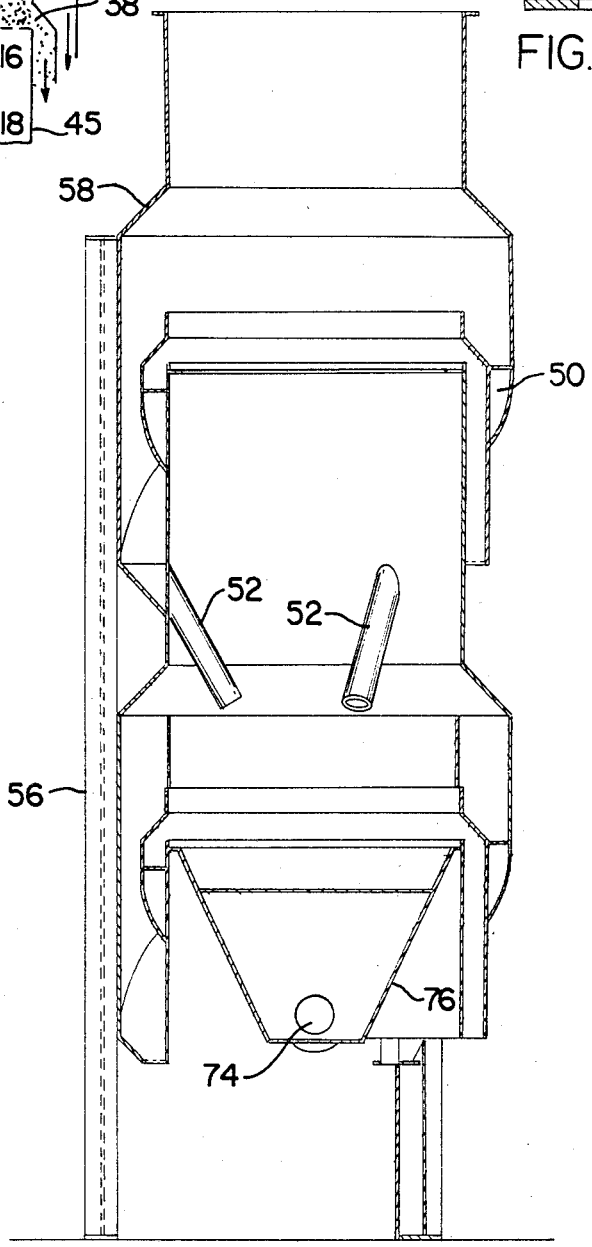
FIG. 2 is a side cross sectional view, in elevation, of a preferred embodiment of a classifier in accordance with the invention.
Figure 3:
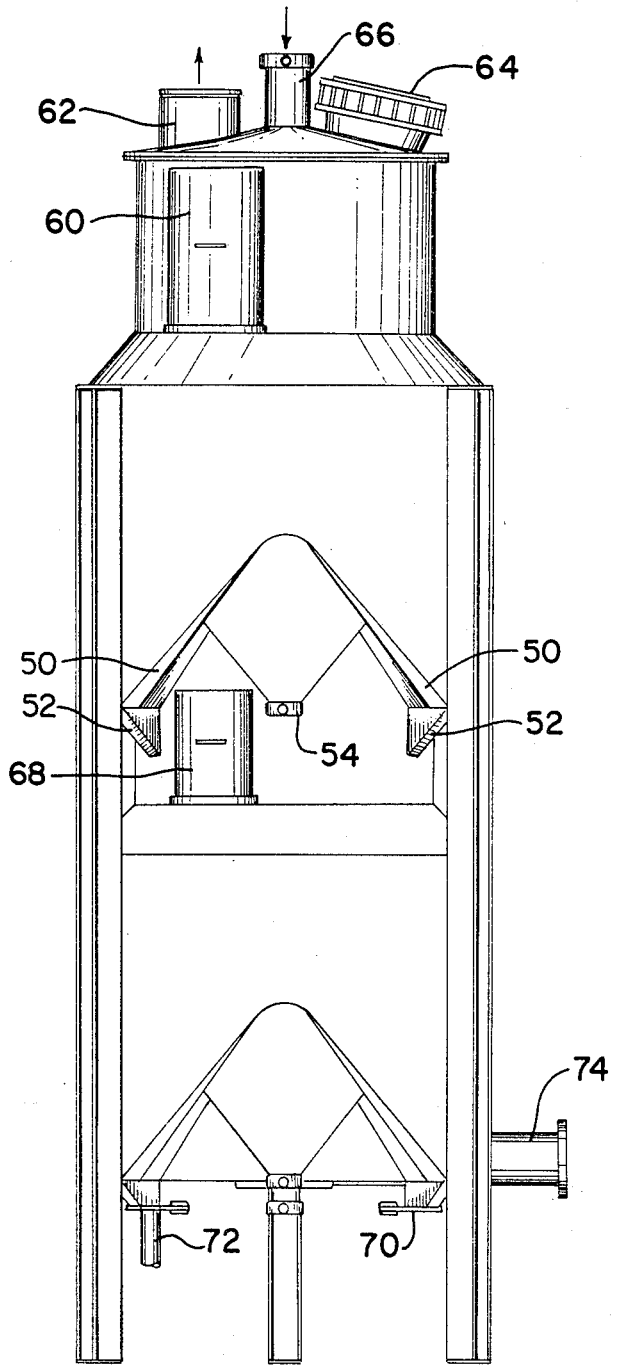
FIG. 3 is a frontal general arrangement view, in elevation, of the classifier of FIG. 2.

FIGS. 2 and 3 together show a general arrangement of selected components of a preferred classifier 10. The classifier 10 is supported about the periphery of the jacket 12 by a plurality, preferably three, of vertical structural supports 56. Atop the supports 56 is supported a feed hopper (not shown). The classifier includes a manway access 60, a fluidizing medium outlet 62, a rupture disk 64, and a feed inlet 66. The fluidizing medium, such as a gas containing dust after passage through the beds, is directed from the outlet 62 to a processing system such as one including a cyclone and/or a baghouse for removal of the dust particles prior to ultimate discharge. The rupture disk 64 may be used in some applications where an explosively hazardous particulate material is being classified or otherwise processed. The feed inlet 66 receives the material to be processed and the hopper is maintained with a supply of particulate material 20 sufficient to meet the process volumetric requirements.

Also shown in FIG. 3 is a manway access 68 and additional detail of the floats ramps 50, and sinks ramps 52 and outlets 54. Associated with the sinks or refuse chute in the lower stage are gate valves 70 to control discharge into a receptacle which can include a conduit 72. The fluidizing medium enters the classifier 10 through an inlet port 74 communicating with a truncated cone 76, and then flows upwardly through the lower perforated plate 16.

Figure 6:
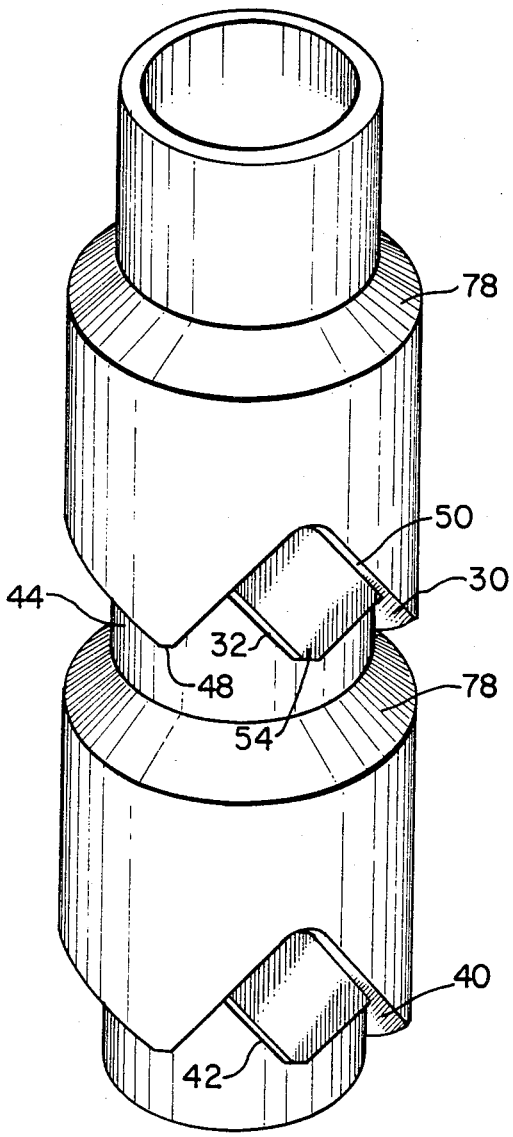
FIG. 6 is a schematic isometric view of a portion of the exterior of a classifier in accordance with the invention.

FIG. 6 schematically shows the general external appearance of the jacket 12 of a classifier 10, including the upper floats annulus 30, upper sinks annulus 32, shell 44, ramps 50, outlets 48 and 54, lower bed secondary annulus 40 and lower bed concentrates annulus 42. Also shown are truncated conical annulus caps 78. It will be apparent that although the floats annulus 30 and sinks annulus 32 narrow the flow of particulate material to, in the exemplary embodiment, three outlets, the overall flow area and peripheral nature of the discharge allow an even distribution and flow of the products, with limited restrictions and pressure drops.

Figure 7:
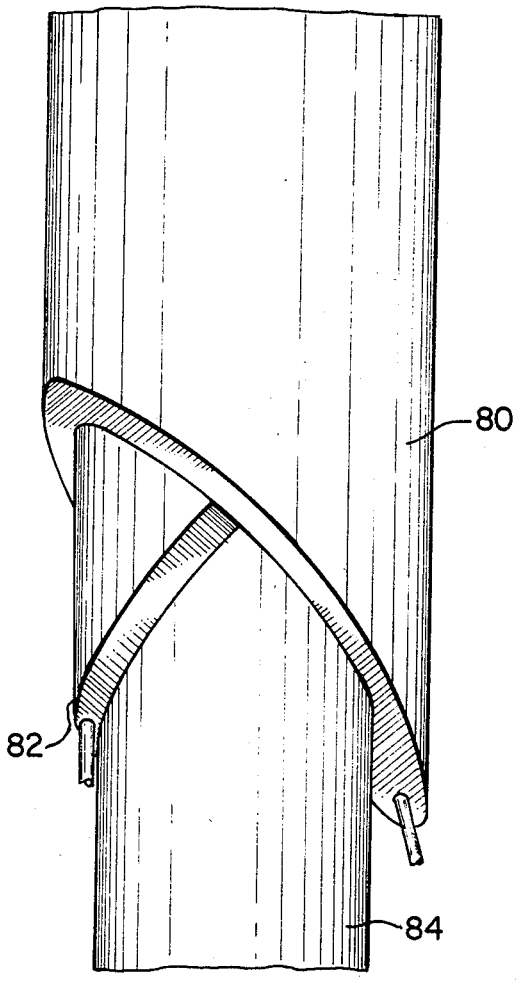
FIG. 7 is another schematic view of a portion of a classifier embodiment showing multiple annuli.

FIG. 7 presents another schematic of an outer annulus 80, inner annulus 82 and central fluidizing medium feed tube 84. Outlets from the annuli can be placed at various selected positions.

Experimental testing on varying types of particulate material, ranging from coal particles between three-quarter inch and 35 mesh (Tyler mesh) to foundry sand in the range of 20 to 270 Tyler mesh has presented significant classification using air as the fluidizing medium. Table I presents the results of testing performed on a single stage bench classifier with peripheral discharge of both floats and sinks. The fluidizing medium was air flowing upwardly at a velocity of approximately 0.47 feet per second. The particulate material to be classified, with the intent of removing the—270 Tyler mesh fraction, was foundry sand. This material was prescreened by hand for test purposes at 10 Tyler mesh. The foundry sand was processed through the classifier, in a single pass, at a rate of approximately 240 pounds per hour.

TABLE I

| | (% Retained) | | |
|---|---|---|---|
| Mesh Size | Feed (Weight %) | Floats (fines) (Weight %) | Sinks (coarse) (Weight %) |
| 20 | 15.51 | 0.20 | 16.73 |

TABLE I-continued

| Mesh Size | Feed (Weight %) | Floats (fines) (Weight %) | Sinks (coarse) (Weight %) |
|---|---|---|---|
| | (% Retained) | | |
| 28 | 44.82 | 0.34 | 48.30 |
| 48 | 22.52 | 3.40 | 24.02 |
| 65 | 6.29 | 16.36 | 5.50 |
| 100 | 6.01 | 32.98 | 3.89 |
| 200 | 2.66 | 20.82 | 1.23 |
| 270 | 1.54 | 18.11 | 0.24 |
| −270 | 0.65 | 7.79 | 0.09 |
| Sample weight (lbs.) | 72.20 | 5.25 | 66.95 |

As evident from review of Table I, the single pass test results are competitive with separation achievable with conventional, more complex classification techniques. The separation can, of course, be further improved with use of multiple stages. It is expected that production scale peripheral discharge classification would not differ significantly from that achieved in the bench scale peripheral discharge classifier.

Modifications and additions can be made to the disclosed structure without departing from the spirit thereof. For example, the input and discharge structures can be arranged in a variety of flow paths while maintaining peripheral discharge at the upper and lower regions of each fluidized bed. A particular contemplated structure includes inletting of the raw feed particulate simultaneously onto two perforated plates spaced one above the other so as to form two beds each discharging floats to a common receptacle outside of the jacket and discharging sinks to another common receptacle also outside of the jacket. For such structure an upper inlet tube can be positioned as shown in FIG. 1, and a lower inlet tube can be positioned extending laterally and downwardly through the jacket and into a lower vertical tube discharging onto the lower of the perforated plates. Other modifications are possible. It therefore is intended that the foregoing description be taken as illustrative, and not in a limiting sense.

We claim:

1. Apparatus for classifying particles of differing specific gravities comprising:

an upper flat perforated plate;

means for feeding said particles onto said upper plate;

means for flowing a fluidizing medium upwardly through said upper plate so that said particles are partially fluidized and segregated into an upper fluidized floats fraction and a lower packed sinks fraction separated by an interface region;

said feeding means positioned to discharge said particles directly into said interface region;

an upper peripheral housing, having an open top and an open bottom, for laterally supporting said particles above said upper plate, said upper housing having a first upper peripheral opening extending along the entire circumference of said upper housing for peripheral-discharging said floats fraction and being spaced from said upper plate, forming a first lower peripheral opening between said upper plate and said upper housing, extending along the entire circumference of said upper housing for peripheral-diischarging said sinks fraction;

a lower flat perforated plate disposed below said upper plate;

a lower peripheral housing having an open top and an open bottom, for laterally supporting particles above said lower plate, said lower peripheral housing having a second upper peripheral opening extending along the entire circumference of said lower housing for peripheral-discharging an upper refuse fluidized fraction and being spaced from said lower plate, forming a second lower peripheral opening between said lower plate and said lower housing extending along the entire circumference of said lower housing for peripheral-discharging a lower packed secondary fraction;

means for discharging particles from said apparatus;

means for directing one of said floats fraction and sinks fraction from one of the upper and lower peripheral openings, respectively, onto said lower plate, comprising a first annular region completely surrounding said upper plate, having sloped ramps for funneling particles to a first lower annular outlet region;

means for directing the other of said floats fraction and sinks fraction from the other one of the first upper peripheral opening and first lower peripheral opening to said discharge means comprising a second said annular region which funnels particles to a second said lower region; and means for flowing a fluidizing medium upwardly through said lower plate so that the one of said floats fraction and sinks fraction directed onto said lower plate, segregates into said upper refuse fluidized fraction and said lower packed secondary fraction.

2. The apparatus of claim 1 wherein said upper housing is cylindrical.

3. Apparatus for classifying particles of differing physical properties, comprising:

a vertically elongated jacket;

an upper flat circular perforated plate disposed within said jacket;

a lower flat circular perforated plate disposed below said upper perforated plate and within said jacket, said lower plate being of larger diameter than said upper plate;

means for flowing a fluidizing gaseous medium within said jacket upwardly serially through said lower plate and said upper plate, said means including a truncated conical shell;

an upper peripheral housing, having an open top and an open bottom, positioned within said jacket for laterally supporting particles above said upper plate, said upper housing having a first top opening extending along the entire circumference of said upper housing for peripheral-discharging certain fluidized floats of said particles and said upper housing being spaced from said upper plate, forming a first bottom opening between said upper plate and said upper housing, extending along the entire circumference of said upper housing for peripheral-discharging certain packed sinks of said particles, said certain floats and sinks being separated by an interface region;

means for feeding particles into said interface region within said upper peripheral housing whereby, under the influence of said upwardly flowing gaseous medium, said feed particles form said floats and said sinks;

a lower peripheral housing, having an open top and an open bottom, positioned within said jacket for laterally supporting particles above said lower plate, said lower housing having a second top opening extending along the entire circumference of said lower housing for peripheral-discharging certain refuse of said particles and said lower housing being spaced from said lower plate, forming a second bottom opening between said lower plate and said lower housing, extending along the entire circumference of said lower housing for peripheral-discharging certain secondary fractions of said particles, said certain refuse and secondary fractions of said particles being separated by an interface region;

means for directing one of said floats and said sinks into said interface region within said lower housing, comprising a first annular region completely surrounding said upper plate, having sloped ramps for funneling particles to a first lower annular outlet region whereby, under the influence of an upwardly flowing gaseous medium, said one of said floats and sinks directed into said lower housing forms said secondary fractions and said refuse, means for discharging particles from said apparatus and;

means for directing the other of said floats and said sinks from the respective first top opening and first bottom opening to said discharge means, which comprises a second said annular region which funnels particles to a second said lower region.

* * * * *